US010844615B2

(12) United States Patent
Esh, Jr.

(10) Patent No.: US 10,844,615 B2
(45) Date of Patent: Nov. 24, 2020

(54) UNDER DECK DRAINAGE SYSTEM

(71) Applicant: Elmer Esh, Jr., Loysville, PA (US)

(72) Inventor: Elmer Esh, Jr., Loysville, PA (US)

( * ) Notice: Subject to any disclaimer, the term of this patent is extended or adjusted under 35 U.S.C. 154(b) by 78 days.

(21) Appl. No.: 16/003,358

(22) Filed: Jun. 8, 2018

(65) Prior Publication Data

US 2018/0363306 A1 Dec. 20, 2018

Related U.S. Application Data

(60) Provisional application No. 62/520,640, filed on Jun. 16, 2017.

(51) Int. Cl.

| | |
|---|---|
| ***E04F 17/00*** | (2006.01) |
| ***E04B 5/48*** | (2006.01) |
| ***E04F 15/02*** | (2006.01) |
| ***E04B 1/00*** | (2006.01) |
| ***E04B 5/02*** | (2006.01) |

(52) U.S. Cl.

CPC ..... *E04F 17/00* (2013.01); *E04B 1/003* (2013.01); *E04B 5/026* (2013.01); *E04B 5/48* (2013.01); *E04F 15/02183* (2013.01)

(58) Field of Classification Search

CPC . E04B 1/003; E04B 1/40; E04B 1/625; E04B 1/34342; E04B 5/026; E04B 5/48; E04D 13/0477; E04D 13/0481; E04F 15/02183; E04F 17/00

USPC ..... 52/302.1, 302.6

See application file for complete search history.

(56) References Cited

U.S. PATENT DOCUMENTS

| | | | | |
|---|---|---|---|---|
| 4,065,883 | A | 1/1978 | Thibodeau | |
| 4,860,502 | A | 8/1989 | Mickelsen | |
| 5,765,328 | A * | 6/1998 | Moore | E04B 1/003 405/119 |
| 6,226,941 | B1 * | 5/2001 | Stevens | E04B 1/003 52/302.3 |
| 6,279,271 | B1 | 8/2001 | Burkart, Jr. | |
| 6,343,450 | B1 | 2/2002 | Vance, Jr. | |
| 6,415,571 | B2 * | 7/2002 | Risser | E04B 1/003 52/11 |
| 6,688,059 | B1 * | 2/2004 | Walker | E04B 1/003 52/302.3 |
| 6,796,092 | B1 * | 9/2004 | Goebel | E04D 13/0477 52/14 |
| 6,886,302 | B2 * | 5/2005 | Jackson | E04B 1/003 405/118 |

(Continued)

*Primary Examiner* — Brian E Glessner
*Assistant Examiner* — James J Buckle, Jr.
(74) *Attorney, Agent, or Firm* — Miller Law Group, PLLC

(57) ABSTRACT

An under deck drainage system is mounted on rail members connected to the bottom of deck stringers in a transverse orientation thereto. The rail members increase incrementally in thickness from the proximal end of the deck to the distal end of the deck where the water is discharged from the under deck drainage system so as to provide proper slope for the drainage of water by the under deck drainage system. A ventilation panel is mounted to the periphery of the deck to enclose the under deck drainage system yet provide an adequate supply of air to the system for drying water therefrom. The ventilation panel is formed with a ventilation portion that is located below the level of the deck stringers, and with a hem portion that has sufficient length to cover the under deck drainage system from view even at the distal end of the deck.

9 Claims, 6 Drawing Sheets

(56) References Cited

U.S. PATENT DOCUMENTS

| | | | | |
|---|---|---|---|---|
| 7,028,437 | B2 | 4/2006 | Hauck | |
| 7,051,485 | B2 | 5/2006 | Burnette | |
| 7,434,358 | B2 | 10/2008 | Smith | |
| 8,082,712 | B1 * | 12/2011 | Butler | E04B 1/003 454/367 |
| 8,245,451 | B2 * | 8/2012 | Whitten | E04F 17/00 52/14 |
| 8,250,821 | B1 * | 8/2012 | Gibson | E04F 17/00 52/11 |
| 8,522,499 | B2 | 9/2013 | Manson | |
| 9,032,678 | B2 * | 5/2015 | Shaw | E04B 1/64 52/302.1 |
| 9,187,911 | B2 | 11/2015 | Bowman | |
| 2003/0029096 | A1 * | 2/2003 | Burkart, Jr. | E04D 13/0477 52/11 |
| 2006/0162262 | A1 * | 7/2006 | Smith | E04B 1/34342 52/58 |
| 2009/0266018 | A1 * | 10/2009 | Stockton | B23B 47/28 52/302.3 |
| 2011/0308178 | A1 * | 12/2011 | Daddio | E04D 13/174 52/198 |
| 2012/0042580 | A1 * | 2/2012 | Manson | E04D 13/0477 52/16 |
| 2014/0215944 | A1 * | 8/2014 | Husler | E04F 15/02044 52/302.1 |
| 2018/0080236 | A1 * | 3/2018 | Peterson | E04B 1/003 |

* cited by examiner

UNDER DECK DRAINAGE SYSTEM

CROSS-REFERENCE TO RELATED APPLICATIONS

This application claims domestic priority on U.S. Provisional Patent Application Ser. No. 62/520,640, filed on Jun. 16, 2017, the content of which is incorporated herein by reference.

FIELD OF THE INVENTION

This invention relates generally to decks or other building structures that are open to the elements, and, more particularly, to a water drainage system that collects water passing through the deck to prevent the water from landing on the structure below the deck.

BACKGROUND OF THE INVENTION

Many residential and commercial buildings are provided with open decks that provide an outdoor space attendant to the building. Such open decks typically do not have a roof overhead and, thus, are exposed to the elements. Often the space beneath the deck is used for a specific purpose, such as storage, or another outdoor living space, and the passage of water, such as from a rain storm, to the structure underneath the deck would not be desirable. Accordingly, water collection systems have been devised to allow the water passing through the deck structure to be collected and diverted to a discharge point to prevent the water from landing on the structure underneath the deck.

Known prior art water drainage collection systems have taken different approaches toward the collection of the water passing through the deck structure. In U.S. Pat. No. 6,279,271, issued to James Burkhart, Jr., on Aug. 28, 2001, the water collection system is a modular grid configuration that is supported from the deck structure to collect water passing through the deck and discharge the collected water into a gutter mounted along the end of the deck. Another complex modular system is disclosed in U.S. Pat. No. 7,434,358, granted to Jeffrey Smith on Oct. 14, 2008, in which the system includes pre-formed pieces that are supported from rail members connected to the stringers of the deck structure, with the stringers providing a slope for the water collection pans supported from the rail members. The discharge of the water collection pans is into a gutter mounted at the distal end of the system.

Other water collection and drainage systems are configured to be mounted on top of the deck stringers or joists, but below the deck flooring. One such system is disclosed in U.S. Pat. No. 4,065,883, granted on Jan. 3, 1978, to Leo Thibodeau, in which the collection members are formed with a bight portion that mounts on top of the deck stringers or joists with the deck boards being nailed to the deck stringers through the bight portion of the collection members. The collection members have a planar water conveying portion that extends between adjacent deck stringers, but the slope of the conveying portion would be dependent on the slope of the deck stringers, which can limit the ability of the conveying portions to discharge water from the system. Similarly, U.S. Pat. No. 7,028,437, granted on Apr. 18, 2006, to Robert Hauck, discloses water collection members that are positioned beneath the deck boards which include a groove to receive a flange of the water collection members. As with the Thibodeau patent, the slope of the water collection members is dependent on the slope of the deck stringers and has limited ability to carry water away from the deck structure.

Other water collection and drainage systems are mounted directly to the deck stringers and are positioned between the stringers, such as is shown in U.S. Pat. No. 5,765,328, issued on Jun. 16, 1998, to Grant Moore, in which U-shaped water collection members are attached to the lower sides of the deck stringers to extend therebetween. The slope of the water collection members can be established by the position at which the water collection members are attached to the sides of the deck stringers. As with other water drainage systems, the collected water is conveyed into a gutter at the distal end of the deck structure. In U.S. Pat. No. 6,688,059, the formed water collection members have a V-shape which can be supported from the bottom of the deck stringers, or alternatively from the top of the deck stringers beneath the deck boards. The slope of the V-shaped water collection members is established by the shape of the formed water collection members which has a deeper profile at the distal end of the deck structure than at the proximal end next to the building structure.

Some water collection and drainage systems mounted transversely to the bottom of the deck stringers, such as is depicted in U.S. Pat. No. 6,886,302, granted to Anslem Jackson on May 3, 2005, in which corrugated V-shaped members are affixed to the lower side of the deck stringers to allow water to be collected and conveyed laterally of the deck structure. In U.S. Pat. No. 7,051,485, granted to Greg Burnette on May 30, 2006, the water collection members are formed with a planar conveying portion positioned below elevated mounted portions that are secured to the lower ends of the deck stringers to extend transversely of the deck structure. Slope of the water collection members would be difficult to establish with such transverse systems unless the collection structure is non-symmetrically formed to induce the slope into the system, as the transverse directions of deck structures are typically without slope.

In U.S. Pat. No. 6,343,450, granted on Feb. 5, 2002, to Robert Vance, Jr., a complex semi-circular water drainage member is supported on the lower end of the respective deck stringers with arced water collection members being supported between adjacent drainage members such that the water falling through the deck structure is received on the arced collection members and conveyed into the nearest water drainage member. The slope of the system can be established by the mounting of the water drainage members on the lower ends of the deck stringers. Alternatively, the water drainage members can be mounted on furring strips attached transversely across the deck stringers to convey collected water laterally of the deck structure. Discharge of the collected water is into a gutter positioned at distal end of the system. In U.S. Pat. No. 8,250,821, issued on Aug. 28, 2012, to George Gibson, the water collection and drainage members are removably supported within brackets mounted to the lower ends of the deck stringers.

Some water collection and drainage systems utilize hangers to support the water collection members, as is disclosed in U.S. Pat. No. 4,860,502, issued to Michael Mickelsen on Aug. 29, 1989, in which hangers are connected to the vertical sides of the deck stringers below the deck boards to hang downwardly along the sides of the deck stringers. A formed water collection member is supported on the ends of the hangers to collect water between the deck stringers. Slope for drainage of the collected water is established by the respective positions the hangers are mounted on the deck stringers. In U.S. Pat. No. 8,082,712, granted to David Butler, et al., on Dec. 27, 2011, the hangers are formed as mechanical clasps that are attached to the vertical sides of the deck stringers to clamp onto the water collection members extending between the adjacent hangers. Similarly, U.S. Pat. No. 9,187,911, granted to Heath Bowman on Nov. 17, 2015, discloses hangers attached to the lower ends of the deck stringers to support water collection members therefrom.

U.S. Pat. No. 8,522,499, granted on Sep. 3, 2013, to Rodney Manson, discloses a deck drainage system in which rail members are attached laterally across the lower ends of the deck stringers with the thickness of the rail members increasing toward the distal end of the deck structure. The water collection members are formed with different connected structures at the opposing sides thereof such that one connecting structure will nest into the connecting structure of the opposing side, wherein the first connecting structure of one water collection member nests into the second connecting structure of the adjacent water collection member with the second collection structure being secured to the respective rail members with fasteners. In the Manson water drainage system, the water collection members are oriented parallel to the deck stringers to convey collected water into a gutter mounted at the distal end of the system. The slope of the deck drainage system is established by the increasing thicknesses of the rail members with respect to the distal end of the deck structure.

Each of these deck drainage system configurations are typically covered by trim boards or other structure connected to the outer structure of the deck to hide the water collection and drainage system from viewing from outside the deck structure. Such trim covering restricts the flow of air to the water collection and drainage system and allows the collected water to remain, at least partially, within the water collection and drainage panels. Furthermore, the collection of the water passing through the deck structure typically wets the deck stringers before falling into the water collection members. With the restriction of air flow around the deck stringers due to the trim covering and to the water collection and drainage system itself, the deck stringers have difficulty drying. As a result, the deck stringers have a tendency to degrade structurally due to the wet surface and over time have to be replaced.

Of the above-identified deck drainage systems, only U.S. Pat. No. 8,082,712, granted to David Butler, et al., on Dec. 27, 2011, teaches a ventilation of the water collection and drainage system. In the Butler patent, a ventilation opening is formed into the floor of the water collection and drainage member, fitted with an open collar and provided with a barricade that directs water around the ventilation opening. With this ventilation opening, air can flow into the water collection and drainage system to help dry the system and the deck stringers after water has been collected and drained away. Because the ventilation opening is vertical and in the path of water falling through the deck structure, a shroud is provided over the barricade to prevent water from passing directly through the ventilation opening and onto the structure present beneath the deck.

It would be desirable to provide an improved deck drainage system that is simple and easy to install, and incorporates a ventilation system that facilitates the drying of the deck drainage system and the deck stringers supporting the deck drainage system.

SUMMARY OF THE INVENTION

It is an object of this invention to overcome the disadvantages of the prior art by providing an under deck drainage system to drain water passing through a deck to a downspout for disposal away from the underside of the deck structure.

It is another object of this invention to provide a ventilation system for an under deck drainage system.

It is a feature of this invention that a ventilation panel is mounted around the perimeter of the deck to enclose the under deck drainage system from external viewing.

It is another feature of this invention that the ventilation panel is formed with a hem portion extending below a ventilation portion to cover the sloped under deck drainage system.

It is an advantage of this invention that the ventilation panel facilitates the drying of the under deck drainage system.

It is another advantage of this invention that the under deck drainage system is covered by the ventilation panel to provide a more pleasing aesthetic appearance.

It is still another feature of this invention that the under deck drainage system is mounted on rail members connected transversely to the underside of the deck stringers.

It is still another advantage of this invention that the thickness of the rail members can increase incrementally as the rail members are located longitudinally downstream of the flow of water passing through the deck so as to provide a proper slope for the water drainage panels.

It is yet another feature of this invention that the ventilation portion of the ventilation panels are located vertically below the deck joists or stringers to provide adequate air flow into the under deck drainage system to dry water therefrom.

These and other objects features and advantages are accomplished according to the instant invention by providing an under deck drainage system that is mounted on rail members connected to the bottom of the deck stringers in a transverse orientation thereto. The rail members increase incrementally in thickness from the proximal end of the deck to the distal end of the deck where the water is discharged from the under deck drainage system so as to provide proper slope for the drainage of water by the under deck drainage system. A ventilation panel is mounted to the periphery of the deck to enclose the under deck drainage system yet provide an adequate supply of air to the system for drying water therefrom. The ventilation panel is formed with a ventilation portion that is located below the level of the deck stringers, and with a hem portion that has sufficient length to cover the under deck drainage system from view even at the distal end of the deck.

BRIEF DESCRIPTION OF THE DRAWINGS

The advantages of this invention will become apparent upon consideration of the following detailed disclosure of the invention, especially when taken in conjunction with the accompanying drawings wherein.

DETAILED DESCRIPTION OF THE PREFERRED EMBODIMENTS

Figure 1:
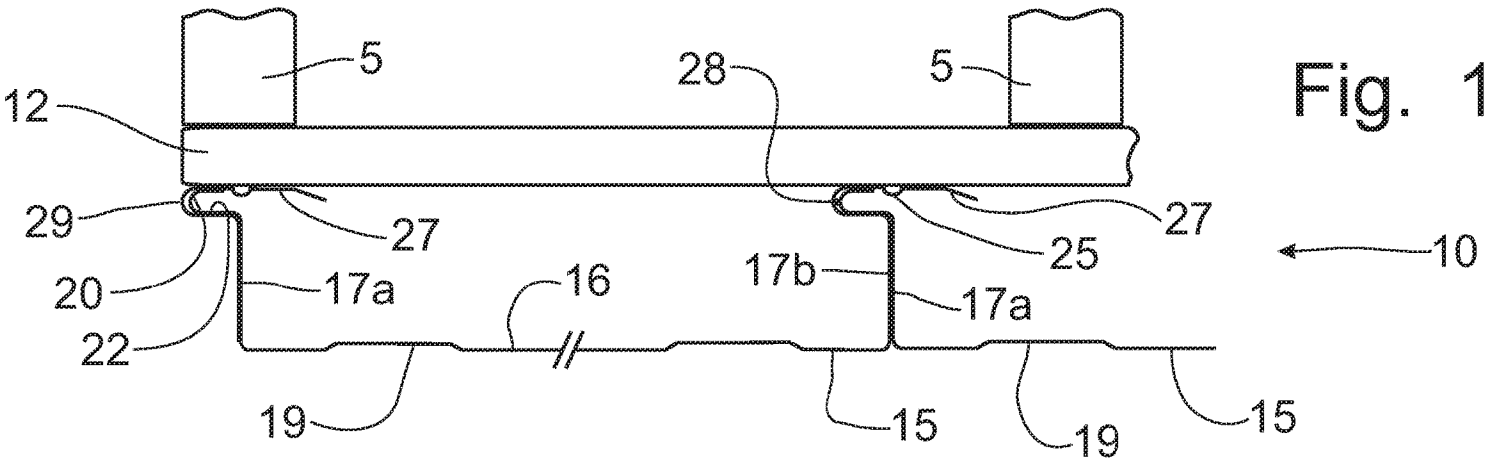
FIG. 1 is a schematic side elevational view of a portion of an under deck drainage system incorporating the principles of the instant invention, the water drainage panels having a first configuration that abuts adjacent panels.

Referring now to FIG. 1, a first configuration of an under deck drainage system incorporating the principles of the instant invention can best be seen. The deck structure is represented by the portions of the deck stringers 5 to which deck boards are secured on top to form the deck floor, as one of ordinary skill in the art will recognize. The under deck drainage system 10 includes a plurality of rail members 12 secured transversely across the lower ends of the deck stringers 5 by fasteners (not shown). The under deck drainage system 10 further includes a plurality of water drainage panels 15 formed with a generally planar floor portion 16 that conveys the collected water toward the distal end of the system, as will be described in greater detail below, and two opposing upright walls 17*a*, 17*b* terminating, respectively, in first and second connection members 20, 25. Optionally, to increase the rigidity of the floor portion, the floor portion 16 could be formed with one or more raised ribs 19.

Figure 2:
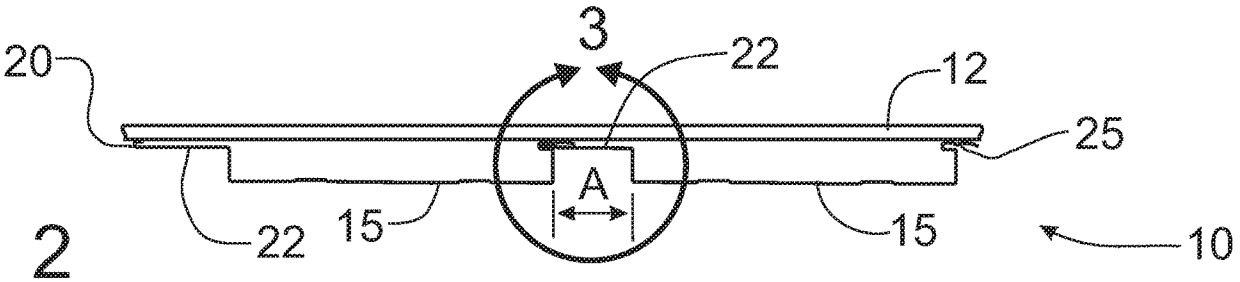
FIG. 2 is a schematic side elevational view of a portion of an under deck drainage system incorporating the principles of the instant invention, but having the water drainage panels formed in a second configuration that provides a reveal between the adjacent panels.

The first connector 20 is preferably formed as a partial, semi-circular loop extending generally horizontally from the first upright wall 17*a* and has a thickness dimension that allows for a nesting arrangement with the second connector 25. The first connector 20 includes a horizontally extending portion 22 that projects perpendicularly to the first upright wall 17*a* for a predetermined distance. In the configuration depicted in FIG. 1, the horizontal distance of the portion 22 is at a minimum value that allows the first connector 20 to nest into the second connector 25 and also to position the first upright wall 17*a* of one water drainage panel 15 in an abutting relationship with the second upright wall 17*b* of an adjacent water drainage panel 15. In the second configuration of the water drainage panels 15 depicted in FIGS. 2 and 3, the length of the horizontal extending portion 22 is longer which results in a spacing A between the first upright wall 17*a* of one water drainage panel 15 and the second upright water drainage panel 17*b* of the adjacent water drainage panel 15. This offset spacing A in the second configuration creates a reveal 24 that provides a significantly different aesthetic appearance than is created by the first configuration of the under deck drainage system 10.

Figure 3:
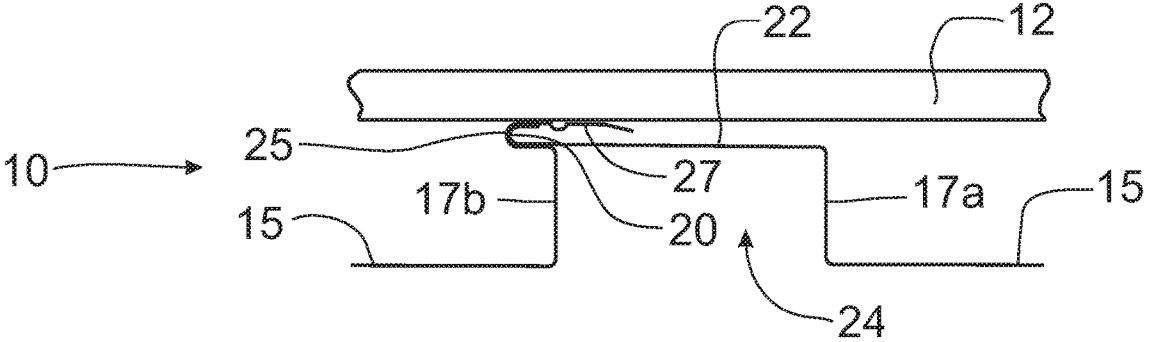
FIG. 3 is an enlarged schematic portion of the second configuration of water drainage panels corresponding to circle 3 in FIG. 2.

The second connector 25 is also formed as a partial, semi-circular loop that has a slightly larger diameter than the loop of the first connector 20 so that the first connector loop 20 will fit into the second connector loop 25 and nest therein, as is best depicted in FIGS. 1 and 3. The second connector 25, however, is also formed with an upper, generally horizontal extension 27 that overlies the second upright wall 17*b* in a return from the loop of the second connector 25. Preferably, the tip of the horizontal extension 27 is bent downwardly toward the panel floor 16 to direct any water landing thereon into the water drainage panel 15. The horizontal extension 27 also provides structure for the insertion of a fastener (not shown) that can pass through the horizontal extension 27 into the rail member 12 adjacent thereto. The horizontal extension 27 can also be formed with an optional dimple that enhances the strength of the horizontal extension 27.

Figure 4:
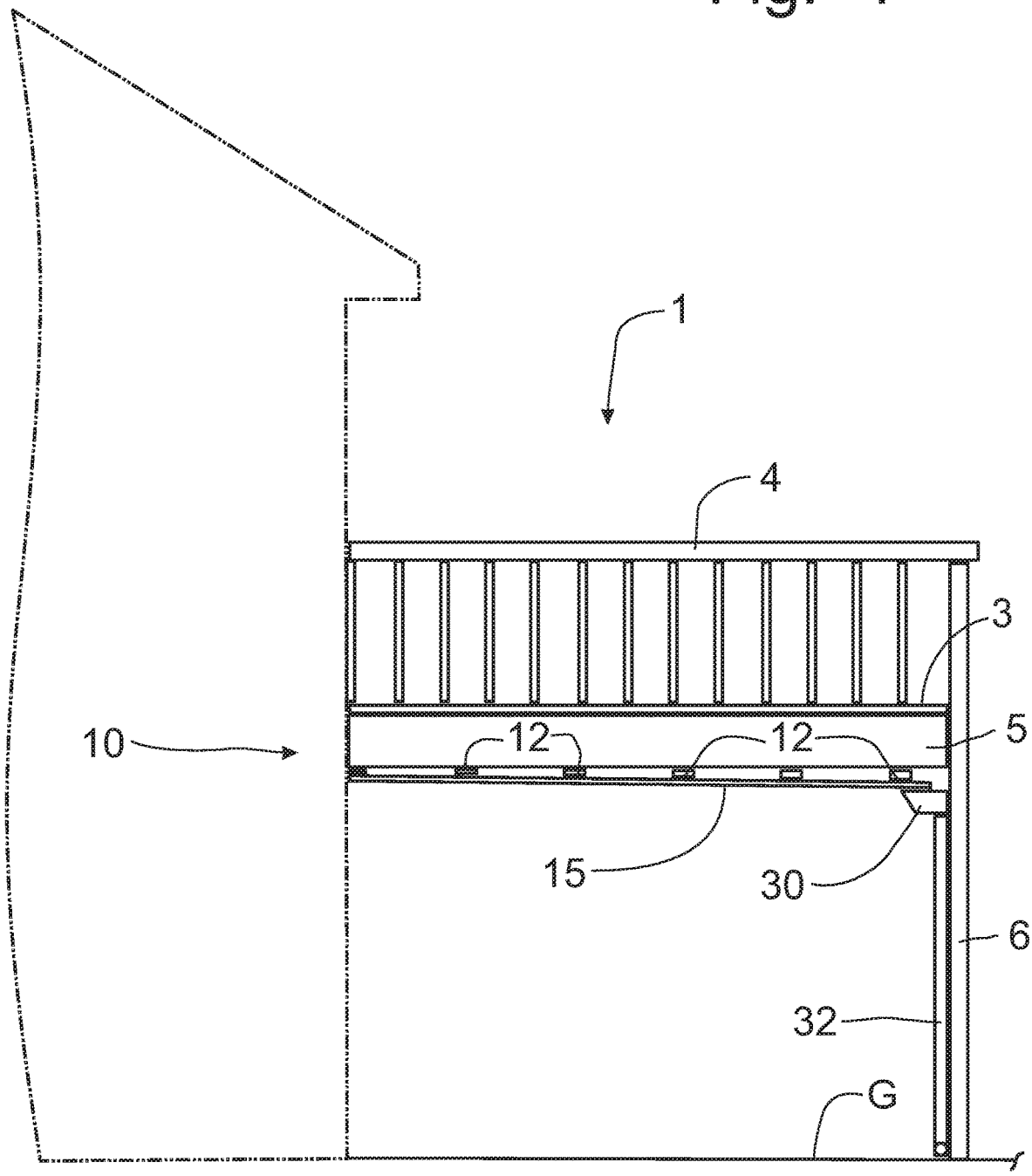
FIG. 4 is a schematic side elevational view of a deck having an under deck drainage system incorporating the principles of the instant invention, the building structure to which the deck is attached being shown in phantom.
Figure 5:
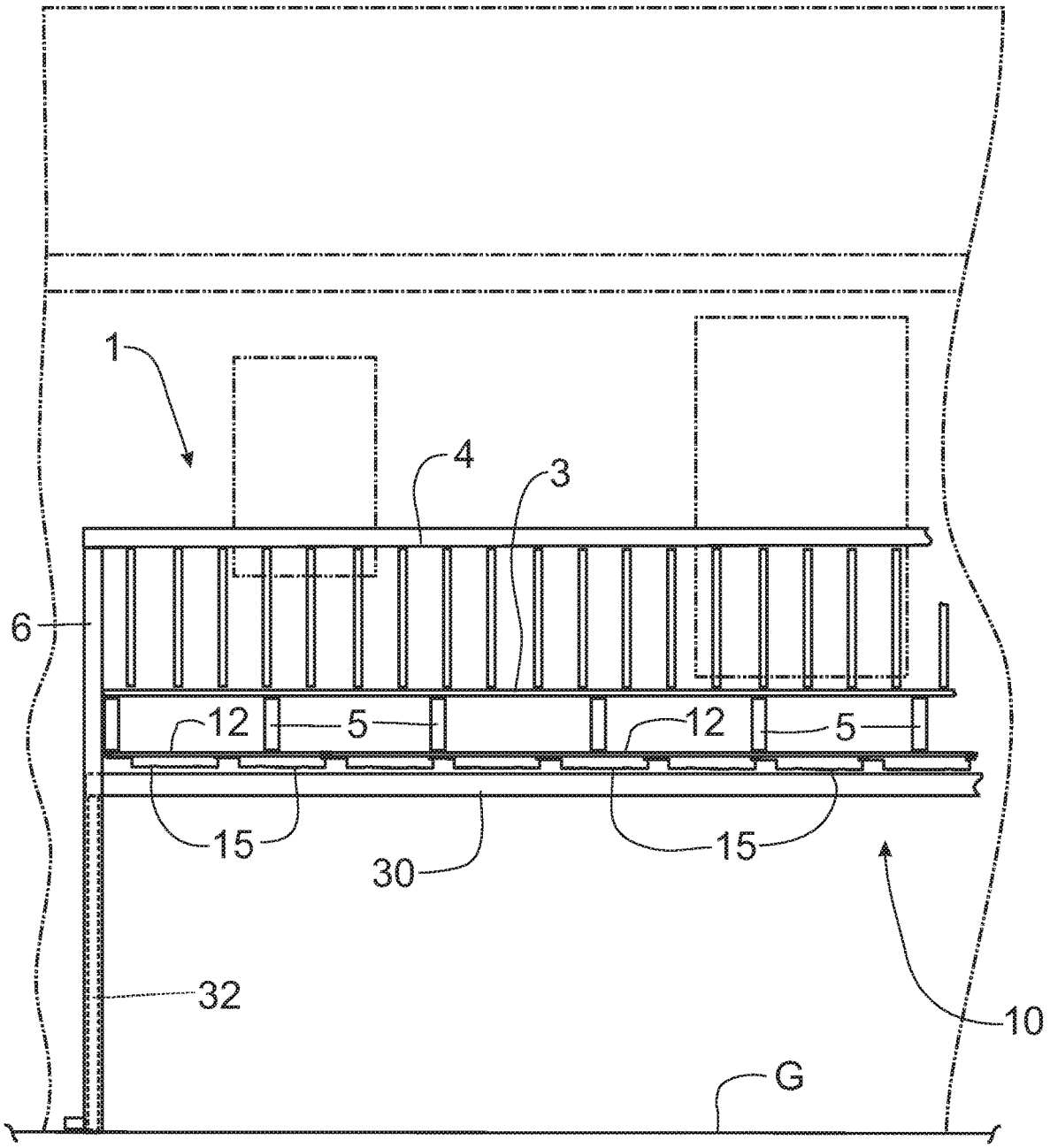
FIG. 5 is a schematic partial front elevational view of the deck shown in FIG. 4 with the water drainage panels being of the second configuration, the remaining portion of the deck structure, and the under deck drainage system, being broken away for purposes of clarity, the representative building structure to which the deck is attached being shown in phantom.
Figure 7:
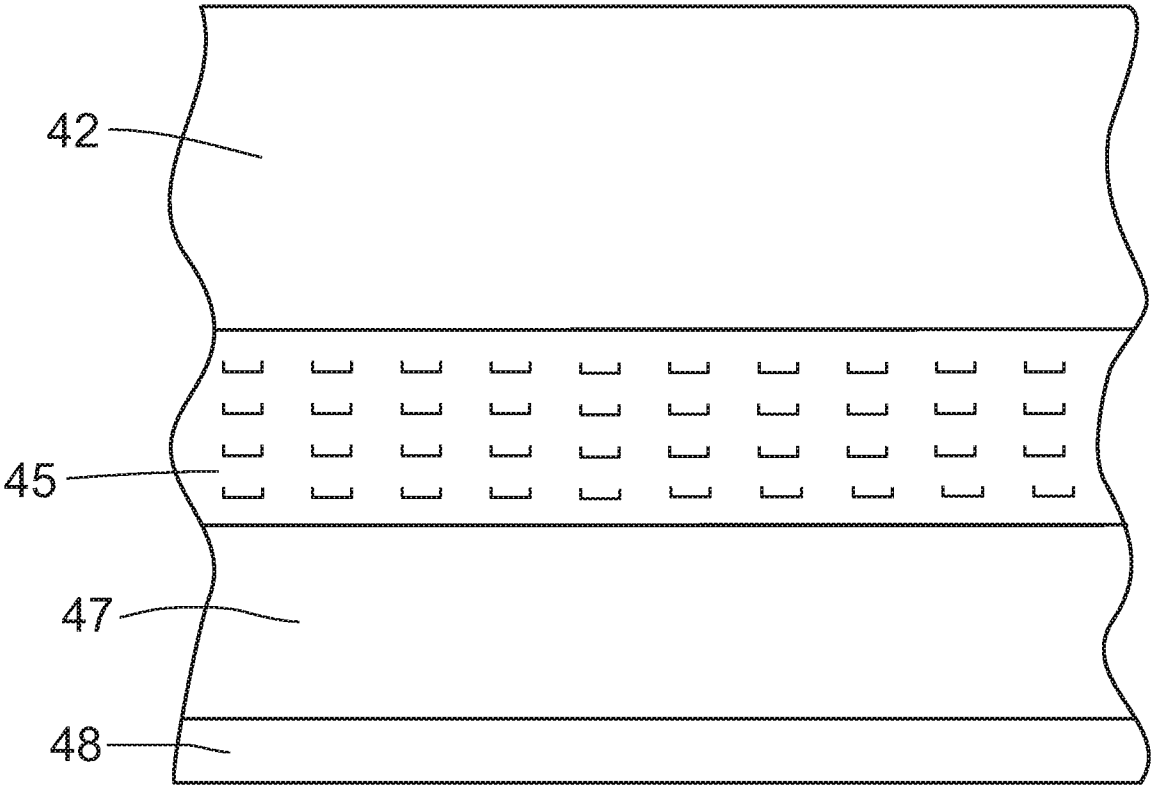
FIG. 7 is a schematic partial front elevational view of the ventilation trim cover member shown in FIG. 6.
Figure 6:
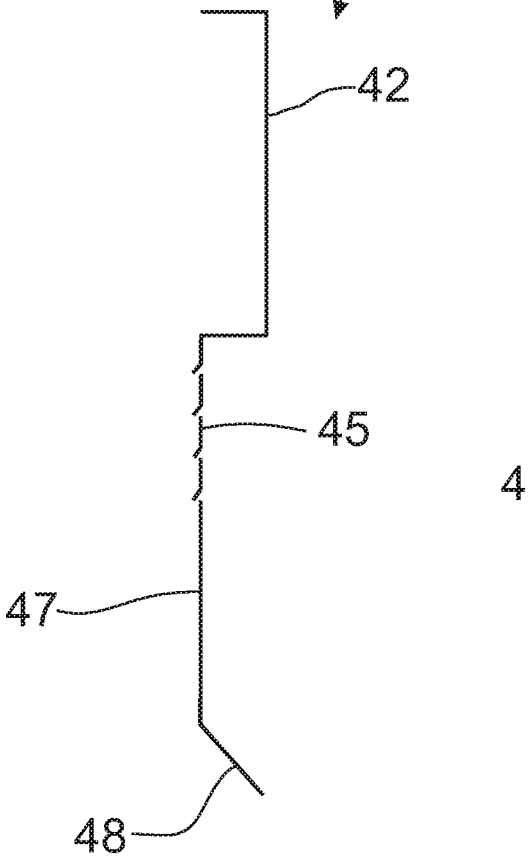
FIG. 6 is a schematic side elevational view of the ventilation trim cover member incorporating the principles of the instant invention.
Figure 9:
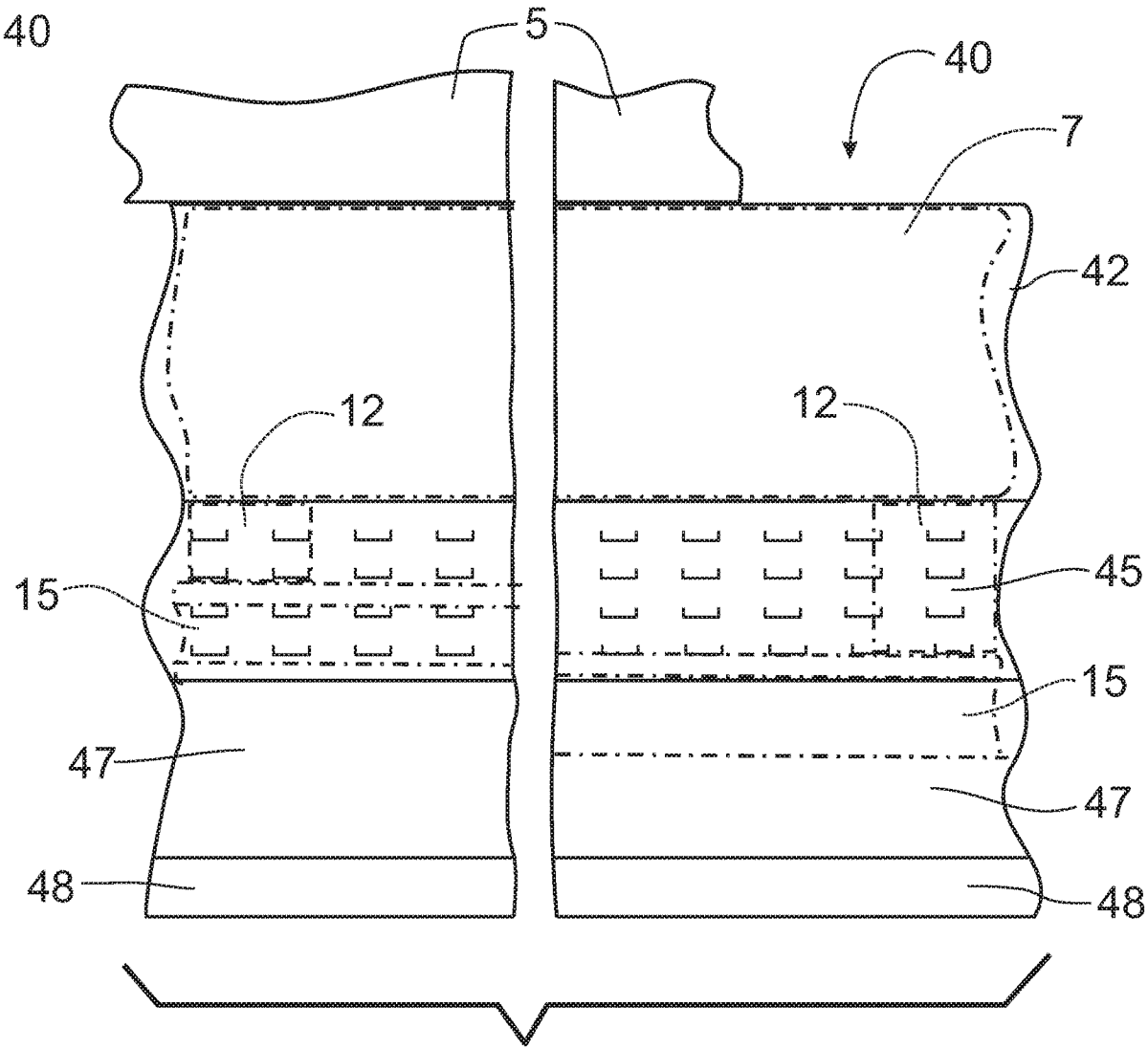
FIG. 9 is a schematic partial front elevational view of the ventilation trim cover member installed along the side of the deck structure.

The application of the under deck drainage system 10 to a deck 1 associated with a building structure shown in phantom can be seen in FIGS. 4 and 5. The deck 1 is generally formed with longitudinally extending joists 5 supported by the building structure at the proximal end and vertical supports 6 at the distal end of the deck 1. The joists 5 are typically covered on the upper surface thereof by decking panels 3 that provide the walking or support surface of the deck structure 1. Often, a railing 4 is supported on the deck 1 around the perimeter of the deck to provide a measure of safety if required. Also, steps (not shown) are usually provided at some point around the perimeter of the deck 1 to permit access from the ground surface G onto the deck 1 without passing through the building structure.

The under deck drainage system 10 starts with the application of rail members 12 attached to the underside of the joists 5 in a transverse orientation to the joists 5 such that each rail member 12 is attached to all of the joists 5 forming part of the deck structure 1. For situations where the deck 1 is constructed in a level orientation from the proximal end to the distal end, the rail members have increasing thickness in relation to the distance from the building structure. Accordingly, the first rail member 12 next to the building structure has a thickness that is less than the second longitudinally spaced rail member 12, which then has a thickness less than the next rail member and so on to the distal end of the deck 1. Preferably, the rail members 12 are poly rails, i.e. boards that are manufactured from a plastic material rather from wood, although wooden rails 12 would be equally appropriate.

As a rule of thumb, the under deck drainage system 10 should have a slope from the proximal end to the distal end of at least 1.25 inches over 12 feet of longitudinal length of the joists 5. This minimum slope computes to a quarter inch of rail member thickness at every 28.5 inches of joist 5 longitudinal length. Therefore, a convenient placement of the rail members 12 is at 28.5 inch spacing along the length of the joists 5. Then, each rail member 12 should have an increased thickness of one-quarter of an inch. Thus, if the deck 1 has a length of 12 feet from the proximal end to the distal end, the first rail member 12 would have a thickness of one-quarter inch and the last rail member 12 would have a thickness of 1.5 inches.

The water drainage panels 15 are then mounted to the rail members 12 in an orientation that is generally parallel to the orientation of the joists 5. A starter member 29, best seen in FIG. 1, comprising essentially the second connection member 17*b*, is secured to the rail members 12 along one lateral side of the deck 1. The first water drainage panel 15 is then mounted to the starter member 29 by nesting the first connector 20 into the second connector 25 of the starter member 29. The second connector 25 of the first water drainage panel 15 is then raised to the rail members 12 and fastened thereto. This process continues across the underside of the deck 1, with the first connector 20 of the next panel 15 being nested into the second connector 25 of the previously fastened panel 15 and then the second connector 25 fastened to the rail members, until the entire underside of the deck is covered with water drainage panels 15. The water drainage panels 15 can be pre-formed, or cut on-site, with a length that extends from the proximal end of the deck to be positioned above a water collection apparatus, preferably in the form of a gutter 30, that is preferably mounted to the vertical supports 6 to receive the flow of water from the water drainage panels 15 and discharge same via a down spout 32 to a remote location away from the deck 1.

A ventilation panel 40 is best seen in FIGS. 6-11. Conventional under deck drainage systems typically have trim boards placed around the circumference of the deck 1 to hide the under deck drainage system. Such trim boards restrict the flow of air into and out of the under deck drainage system 10. The ventilation panel 10 incorporating the principles of the instant invention provides adequate ventilation for the under deck drainage system 10 to allow the drainage system 10 to dry after collecting water falling through the decking panels 3. Allowing the drainage system 10 to dry preserves the life of the joists 5 supporting the decking panels 3.

Figure 8:
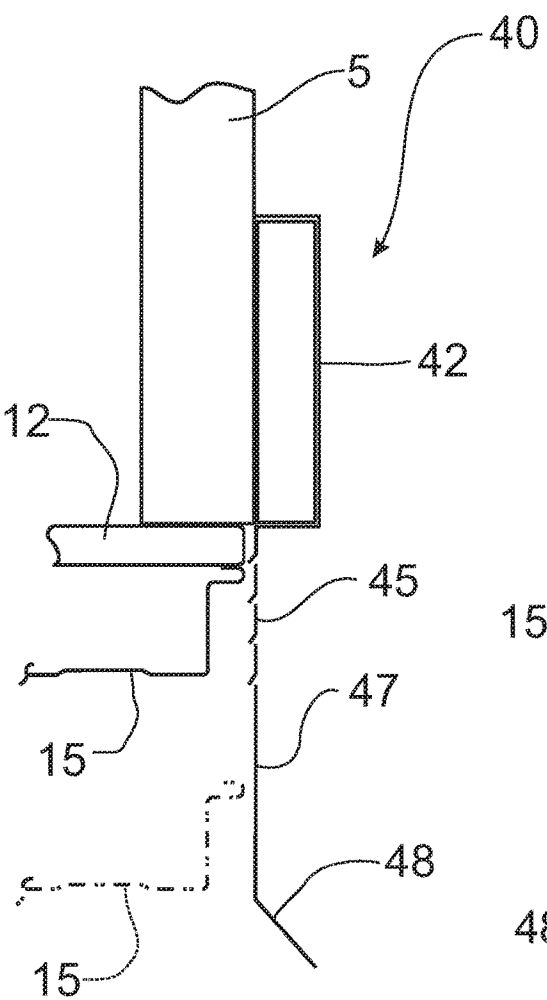
FIG. 8 is a schematic side cross-sectional view of the ventilation trim cover member installed on the side of a deck structure to cover the under deck drainage system, the slope of the water collection member being depicted in the positioning of the portion of the water drainage panel shown in phantom as compared to the positioning of the portion of the water drainage panel shown in solid lines.
Figure 11:
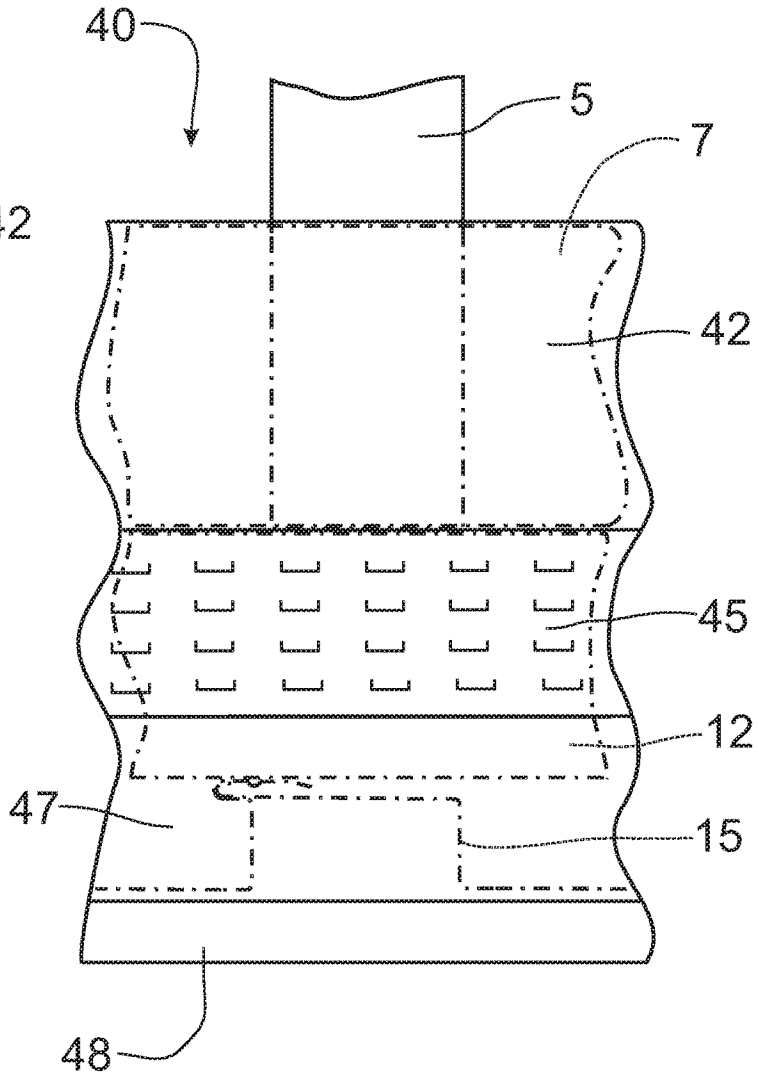
FIG. 11 is a schematic partial front elevational view of the ventilation trim cover member installed on the front of a deck structure.
Figure 10:
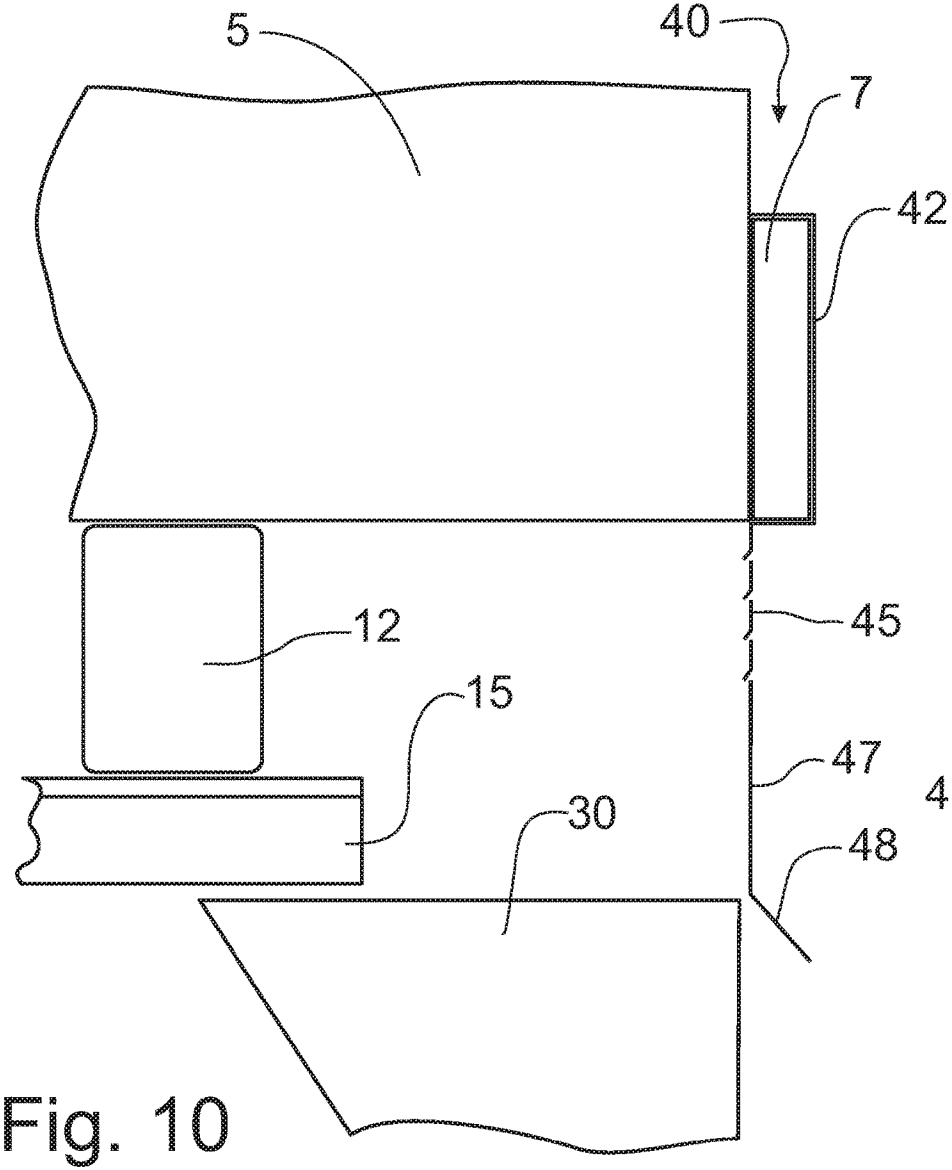
FIG. 10 is a schematic side cross-sectional view of the ventilation trim cover member installed on the front of a deck structure.

The ventilation panels 40 are preferably formed with an enclosure portion 42 that is formed to overlap a trim board 7 that is attached to the lower side of the joists 5 to provide an aesthetically pleasing appearance simulating the conventional trim boards previously installed on the perimeter of decks 1 to cover the drainage system. A ventilated portion 45 is formed below the enclosure portion 42 to be aligned with the side or front faces of the deck 1. As is best seen in FIGS. 8 and 10, the ventilated portion 45 is aligned with the location of the water drainage panels 15 attached to the rail members 12. Along the side of the under deck drainage system 10 the water drainage panels 15 slope downwardly toward the distal end of the deck 1, as is indicated by the phantom position of the water drainage panel 15, and the ventilation portion 45 allows the movement of air through the ventilation panel 40 into the under deck drainage system 10. At the front, or distal end, of the deck 1, the ventilation portion 45 is aligned with the end of the water drainage panels 15 and the gutter 30, as is best seen in FIG. 10.

Below the ventilation portion 45, the ventilation panel 40 is formed with an extended hem portion 47 that has sufficient length to extend below the lowermost positioning of the water drainage panels 15 at the distal end of the deck 1. Optionally, the hem portion 47 can end with a bend end portion 48 that is bent outwardly from the deck 1 to deflect water away from the deck 1. With a ventilation panel 40 formed in the above-described manner, the ventilation panel 40 can be attached to the underlying trim board and hang therefrom in a level manner around the perimeter of the deck structure 1 while hiding the structure of the under deck drainage system 10 with the hem portion 47, even though the water drainage panels 15 are sloped from the proximal end to the distal end, while enabling the flow of air to and from the under deck drainage system 10.

One of ordinary skill in the art will recognize that the ventilation openings formed in the ventilation portion 45 of the ventilation panel 40 can be formed in a variety of ways, included having the ventilation holes punched out of the panel 40, or forming louvers by piercing the ventilation panel 40 on three sides of the ventilation opening and bending inwardly the flap that is formed by the piercing step. As an option, the ventilation portion 45 can incorporate a screen member behind the ventilation openings to prevent the passage of insects through the ventilation openings. In addition, a seal 28 can be inserted between the first and second connectors 20, 25 to provide assurance that water will not pass between the first and second connectors and bypass the water drainage panels 15.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

Having thus described the invention, what is claimed is:

1. An under deck drainage system for mounting beneath a deck to collect water passing therethrough, said deck including vertical supports, a plurality of joists extending in a longitudinal direction and decking mounted on top of said plurality of joists to form a deck surface, comprising:

a plurality of rail members affixed to said plurality of joists and extending transversely of said plurality of joists;

a plurality of water drainage panels connected to said plurality of rail members and extending longitudinally, each of the plurality of water drainage panels including a floor portion terminating in a pair of opposing upright walls, a first of said pair of upright walls having a first connector positioned above said floor portion while a second of said pair of opposing upright walls having a second connector positioned above said floor portion, said first connector being shaped to nest into said second connector, said second connector being shaped to permit connection thereof to said plurality of rail members;

a water collection apparatus mounted at an end of said plurality of water drainage panels to receive a discharge of water therefrom and convey collected water remotely from said deck; and a ventilation panel mounted on an outside peripheral surface of said deck to shield said plurality of water drainage panels from view, said ventilation panel including a ventilation portion having ventilation opening extending therethrough to permit a flow of air into said under deck drainage system, said ventilation panel including a hem portion extending below said ventilation portion, said hem portion having a vertical length sufficient to cover said plurality of water drainage panels even when sloping from a proximal end of said deck to a distal end of said deck.

2. The under deck drainage system of claim 1 wherein said ventilation panel further includes an enclosure portion positioned above said ventilation portion, said enclosure portion being sized to envelope a trim board connected to said deck periphery.

3. The under deck drainage system of claim 1 wherein said plurality of rail members are spaced from a proximal end of said deck toward a distal end of said deck, each of said plurality of rail members having increased thickness corresponding to a distance from said proximal end of said deck to provide a slope for said plurality of water drainage panels.

4. An under deck drainage system for mounting beneath a deck to collect water passing through the deck, said deck including vertical supports, a plurality of joists extending in a longitudinal direction and decking mounted on top of said plurality of joists to form a deck surface, comprising:

a plurality of rail members affixed to a bottom side of said plurality of joists and extending transversely of said plurality of joists, said plurality of rail members being spaced longitudinally relative to said plurality of joists and having an incremental thickness corresponding to a distance spaced from a proximal end of said deck toward a distal end of said deck;

a plurality of water drainage panels connected to said plurality of rail members and extending longitudinally, each said water drainage panel including a floor portion terminating in a pair of opposing upright walls, a first of said pair of upright walls having a first connector positioned above said floor portion while a second of said opposing pair of upright walls having a second connector positioned above said floor portion, said first connector being shaped to nest into said second connector, said second connector being shaped to permit connection thereof to said plurality of rail members, said plurality of water drainage panels having a slope from said proximal end of said deck toward said distal end of said deck to provide drainage of water toward said distal end of said deck;

a water collection apparatus mounted at an end of said plurality of water drainage panels to receive a discharge of water therefrom and convey collected water remotely from said deck; and a ventilation panel mounted on an outside peripheral surface of said deck to shield said water drainage panels from view, said ventilation panel including a ventilation portion having ventilation opening extending therethrough to permit a flow of air into said under deck drainage system, said ventilation panel including a hem portion extending below said ventilation portion, said hem portion having a vertical length sufficient to cover said plurality of water drainage panels even when sloping from said proximal end of said deck to said distal end of said deck.

5. The under deck drainage system of claim 4 wherein said ventilation portion of said ventilation panel is located below said plurality of joists to provide a flow of air into said plurality of water drainage panels.

6. The under deck drainage system of claim 5 wherein said ventilation panel also includes an enclosure portion positioned above said ventilation portion, said enclosure portion being sized to envelope a trim board connected to said deck periphery.

7. An under deck drainage system for mounting beneath a deck to collect water passing therethrough, said deck including vertical supports, a plurality of joists extending in a longitudinal direction and decking mounted on top of said plurality of joists to form a deck surface, comprising:

a plurality of rail members affixed to said plurality of joists and extending transversely of said plurality of joists;

a plurality of water drainage panels connected to said plurality of rail members and extending longitudinally, each of the plurality of water drainage panels including a floor portion terminating in a pair of opposing upright walls, a first of said pair of upright walls having a first connector positioned above said floor portion while a second of said pair of opposing upright walls having a second connector positioned above said floor portion, said first connector being shaped to nest into said second connector, said second connector being shaped to permit connection thereof to said plurality of rail members;

a water collection apparatus mounted at an end of said plurality of water drainage panels to receive a discharge of water therefrom and convey collected water remotely from said deck; and a ventilation panel mounted on an outside peripheral surface of said deck to shield said plurality of water drainage panels from view, said ventilation panel including a ventilation portion having ventilation openings extending therethrough to permit a flow of air into said under deck drainage system, said ventilation portion being positioned laterally from water drainage panels to facilitate said flow of air to circulate laterally above said water drainage panels.

8. The under deck drainage system of claim 7 wherein said ventilation openings are formed as louvers through said ventilation panel.

9. The under deck drainage system of claim 8 wherein said ventilation portion of said ventilation panel is located below said plurality of joists to provide a flow of air laterally across said plurality of water drainage panels.

* * * * *